US006164613A

United States Patent [19]

Williams

[11] Patent Number: 6,164,613

[45] Date of Patent: Dec. 26, 2000

[54] PORTABLE POLE ANCHOR

[76] Inventor: Adrian Ashley Williams, 440 Western Ave. #102, Glendale, Calif. 91201

[21] Appl. No.: 09/368,948

[22] Filed: Aug. 5, 1999

[51] Int. Cl.[7] ..... A45B 1/00

[52] U.S. Cl. ..... 248/533; 248/910

[58] Field of Search ..... 248/533, 530, 248/910, 156, 500

[56] References Cited

U.S. PATENT DOCUMENTS

| | | | |
|---|---|---|---|
| 4,296,693 | 10/1981 | Archer | 248/910 |
| 4,753,411 | 6/1988 | Lechner | 248/533 |
| 5,169,111 | 12/1992 | Dunaj | 248/910 |
| 5,234,280 | 8/1993 | Cowan | 248/910 |
| 5,452,877 | 9/1995 | Riffle et al. | 248/511 |
| 5,535,978 | 7/1996 | Rodriguez | 248/530 |
| 5,765,795 | 6/1998 | Alex . | |
| 5,979,844 | 11/1999 | Hopkins | 248/910 |

*Primary Examiner*—Alvin Chin-Shue

[57] ABSTRACT

An approximately circular, flexible apron is secured to a pole passing through its center. Sand, rocks or other ballast material is placed upon the apron, thus allowing it to serve as an anchor. The apron may include battens to maintain the extended surface upon which ballast is placed. The apron may also be attached to a radial array of support members that are connected to a slide collar that can be locked to the pole. Through the adjustment of the slide collar, the apron can be shaped to provide a basket shape to hold ballast, or the apron can be disposed as a flat surface upon the ground allowing the support members to contribute lateral support to the pole.

7 Claims, 5 Drawing Sheets

PORTABLE POLE ANCHOR

BACKGROUND OF THE INVENTION

1. Field of the Invention

This invention relates to a portable device for anchoring umbrellas, flags and other articles that include a pole or shaft that requires support.

2. Description of Related Art

There are a number of devices in the prior art that serve as anchoring devices for beach umbrellas, volleyball net supports and the like. The present invention is most closely associated with a group that is characterized by the use of sand or other native material to provide ballast for stabilizing the anchor device.

U.S. Pat. No. 4,753,411 discloses a Portable Beach Umbrella Safety Base that comprises two semicircular plates that provide a surface upon which sand can be placed to provide weight to assist in anchoring the device. The semicircular plates are flat, rigid objects that are limited as to the amount of sand or other material that can be supported due to the lack of any sidewalls or other peripheral containment. Although the capacity of the plates can be increased by increasing the size of the plates, this increase comes at the expense of greater weight and inconvenience of handling and storage.

U.S. Pat. No. 5,452,877 discloses a Beach Umbrella Anchor Bag that comprises a flexible enclosure with a relatively narrow opening that surrounds the shaft of a beach umbrella when in use. Although this device has the advantage of being able to accept a greater amount of sand as ballast when compared to the flat plates of the Portable Beach Umbrella Safety Base, the narrow opening limits the size of rocks or other objects that could also be used as ballast materials.

Both of the above described devices are discrete devices that are not integrated with the umbrellas that they are used to support or anchor, nor are they well adapted to streamlined integration with an umbrella shaft. Existing ballast-type devices for anchoring beach umbrellas are also limited in the types of material that can be used as ballast with a particular device.

BRIEF SUMMARY OF THE INVENTION

It is thus an object of the present invention to provide a ballast pole anchor device that is capable of functioning with a broad range of ballast materials.

It is another object of the invention to provide a pole anchor device that is conveniently integrated with articles such as beach umbrellas.

It is a further object of the invention to provide an anchor device that can support a pole without insertion of the pole into the underlying surface.

DETAILED DESCRIPTION OF THE INVENTION

The invention has a number of specific embodiments that differ in the number of components that are present. The preferred embodiment is the embodiment that includes the greatest number of the components. Although a larger number of components carries with it a higher cost of manufacture, this embodiment is preferred because of its versatility of use.

Figure 1:
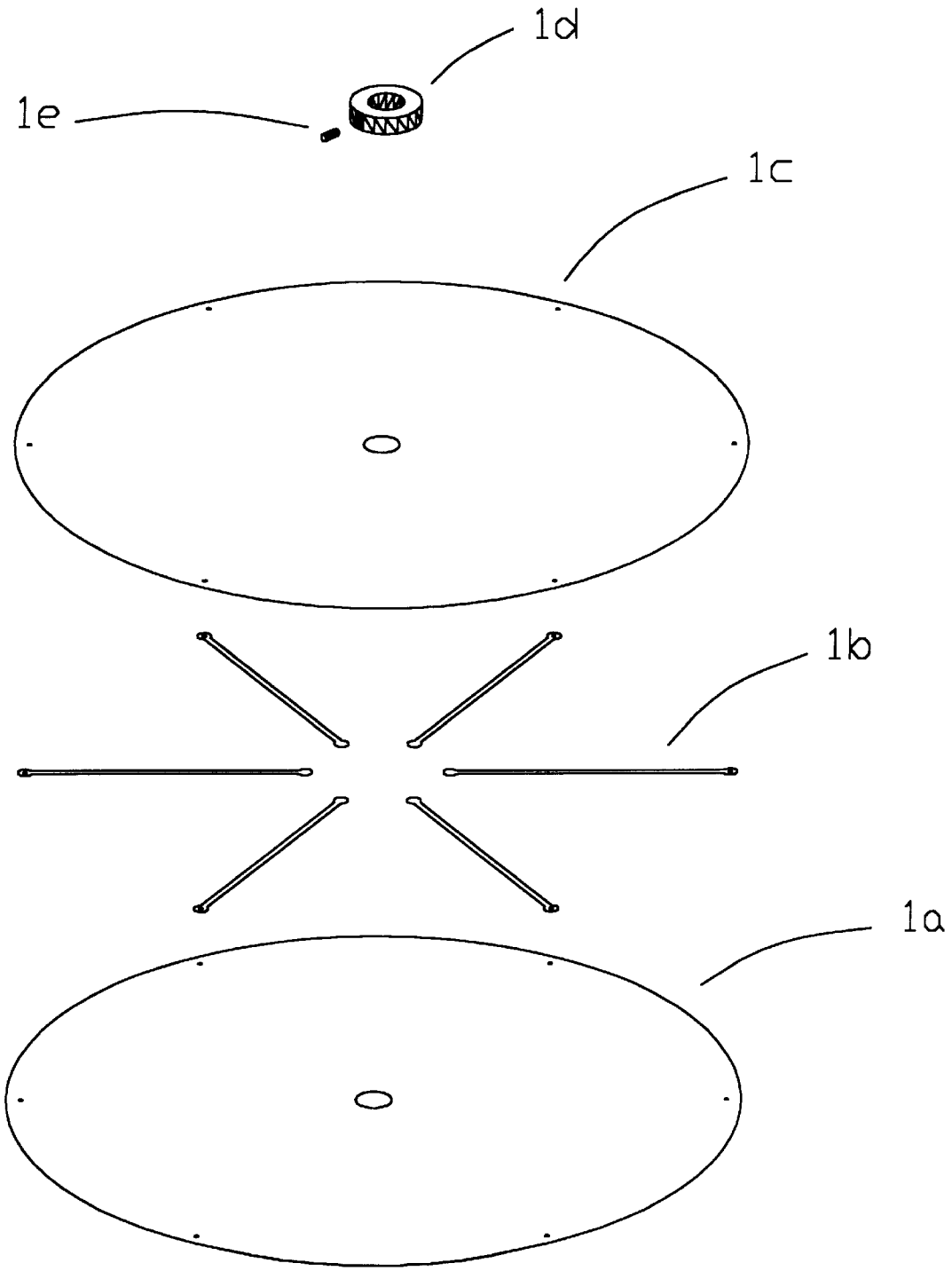
FIG. 1 is an exploded view of the pole anchor apron.
Figure 2:
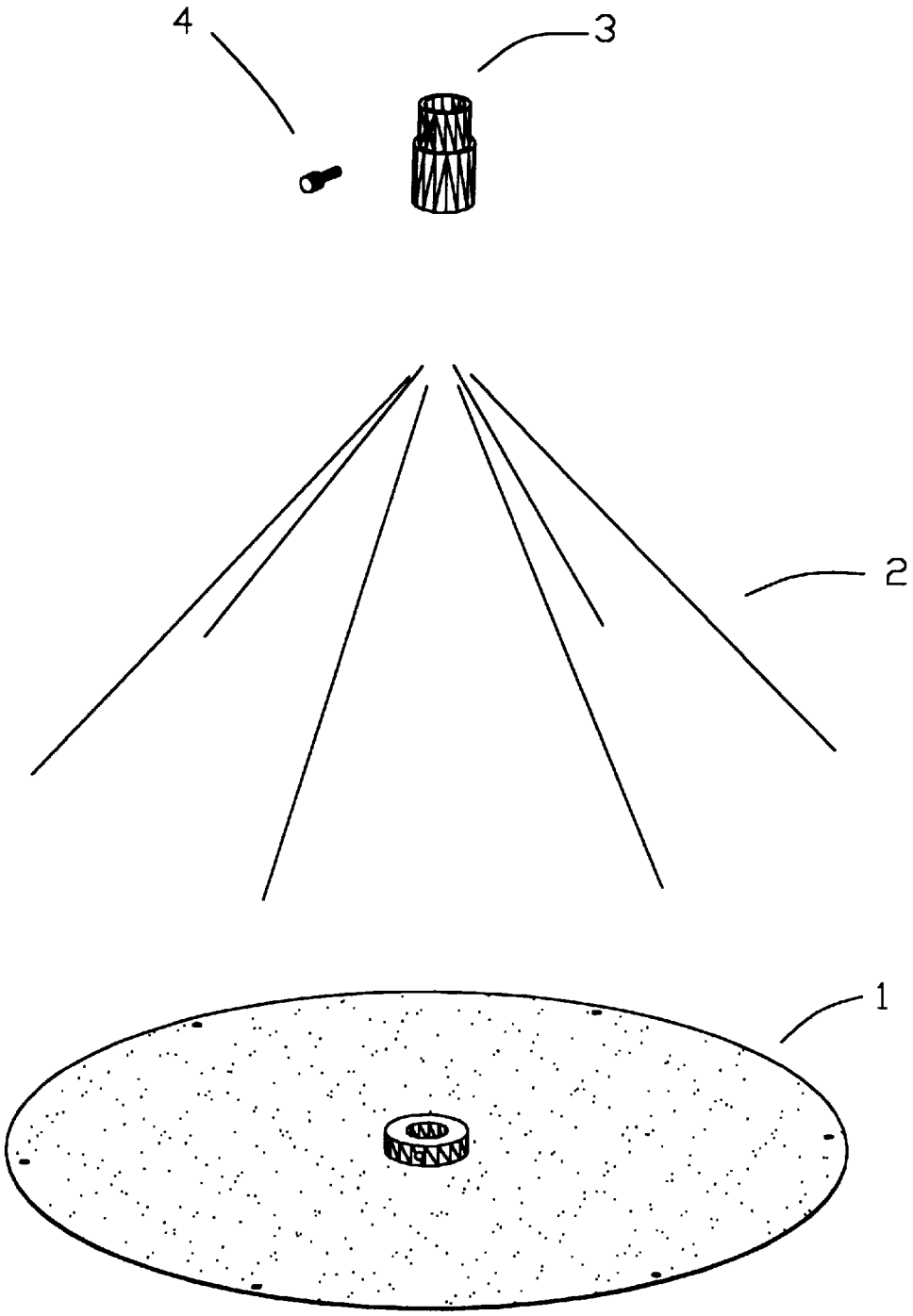
FIG. 2 is an exploded view of the pole anchor.

The apron 1 of FIG. 2 is shown in FIG. 1 as an exploded view. The bottom sheet 1*a* and the top sheet 1*c* sandwich an array of battens 1*b*. The number of battens in this instance is six; however the number of battens may very, and even be omitted altogether. The bottom sheet 1*a* and the top sheet 1*b* are joined in such a manner that they form a flexible composite sheet in which upper surface of the bottom sheet 1*a* and the lower surface of the top sheet 1*b* are bonded together, enclosing the battens and holding them in place. The bonding can be done by stitching with thread, and by using an adhesive such as the thermal adhesive that is used for bonding shirt collars, cloth patches and the like. The top sheet 1*a* and the bottom sheet 1*b* are preferably made of a flexible tear resistant material and are generally flat or concave with a perimeter that has the general shape of a circle or regular polygon. The battens are preferably made of a material such as acetal or nylon that is capable of bending under the application of stress, but also capable of assuming its former shape when the applied stress is removed. The stiffness of the battens is determined by the thickness and material of construction. Although the invention can be practiced without the batten array 1*b* and the bottom sheet 1*a*, the battens function to maintain the extended surface of the composite sheet, thereby maximizing the area that can accept sand or other ballast material. Although omission of the bottom sheet 1*a* and the batten array 1*b* sheet is an embodiment that is cheaper and slightly easier to store, the stiffness imparted by the battens to the extended surface makes handling considerably easier under windy conditions. The top sheet 1*c* is attached to a set collar 1*d*. The set collar 1*d* is essentially a short cylinder that is axially bored to accept a pole and is drilled through radially and tapped to accept a setscrew 1*e*. The top sheet 1*c* is attached to the set collar 1*d*. It is important to note that the interior ends of the batten array 1*b* are located on a circle with a diameter somewhat larger than the outside diameter of the set collar 1*d*. The sheet material in the annular region between the set collar 1*d* and the ends of the battens in the batten array 1*b* acts as a hinge that permits the apron sheet to be easily gathered by rotating the outer ends of the batten array 1*b* so that they lie parallel to the axis of the set collar 1*d*. This hinge effect allows the embodiment with battens to offer improved ease of use under windy conditions, while maintaining ease of handling and storage.

Figure 3:
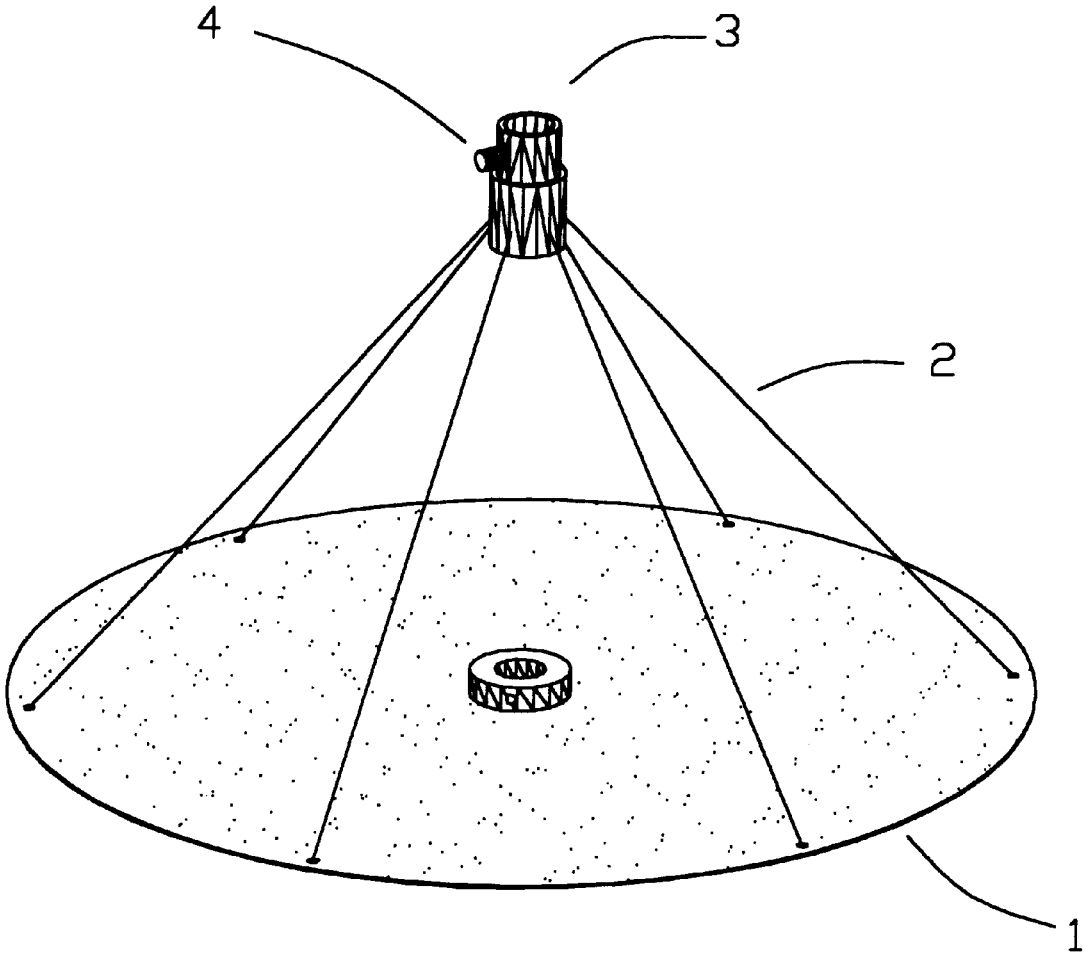
FIG. 3 is an isometric view of the assembled pole anchor.

FIG. 2 And FIG. 3 show respectively an exploded view and assembled view including the apron 1, support element array 2, sliding collar 3 and thumbscrew 4. Although the support element array is shown to contain six support elements, the number of elements may be varied. Each support element has one end attached to the sliding collar 3 and the opposite end attached to the apron 1.

Figure 4:
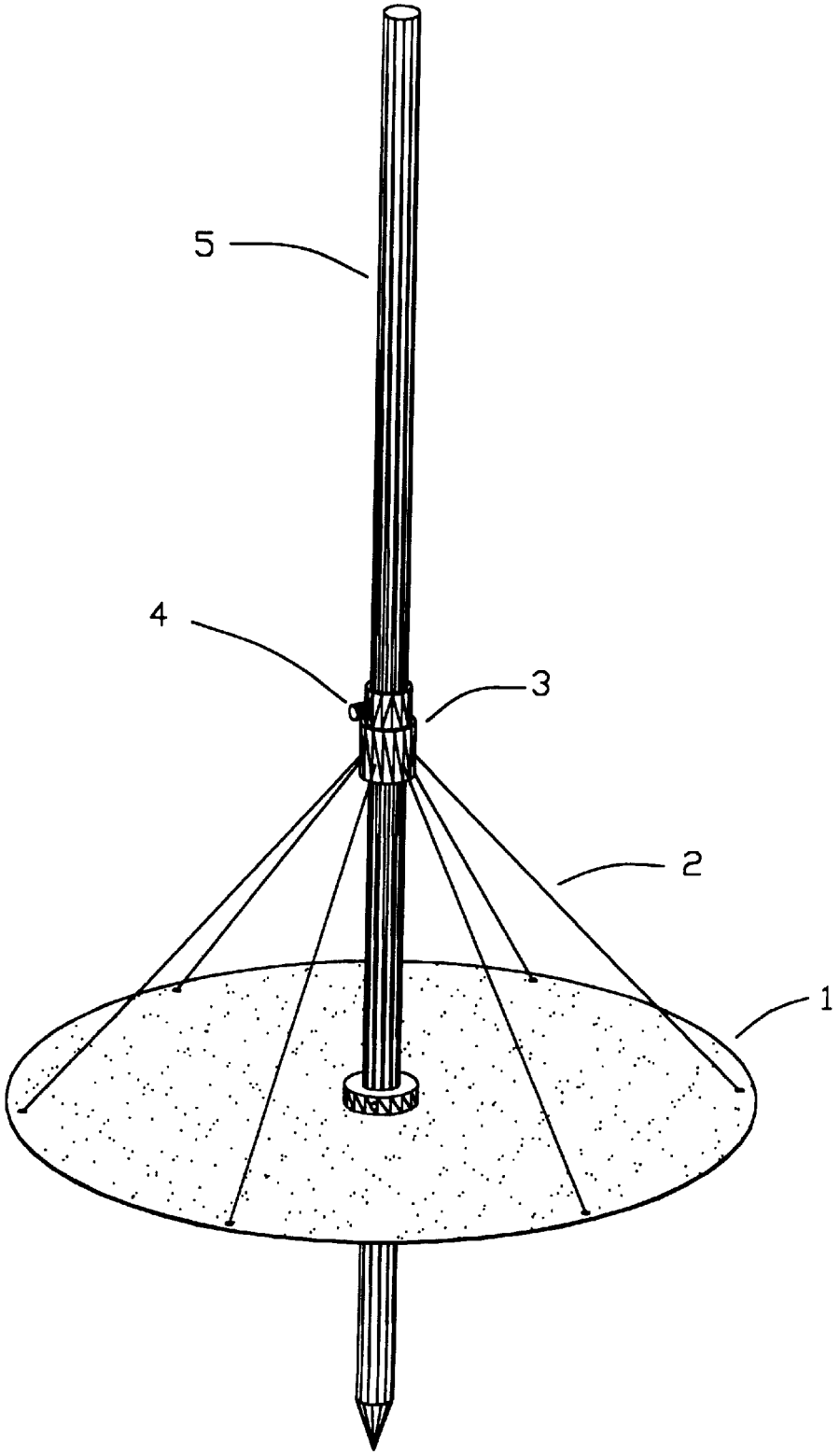
FIG. 4 is an isometric view of the pole anchor attached to a pole with the apron in the flat position.

FIG. 4 shows the invention deployed with a pole 5. In reference to FIG. 4, the invention could be deployed without the support element array 2, sliding collar 3 and thumbscrew 4 by allowing the apron 1 to remain flat to provide a surface upon which sand, rocks, earth and other material can be placed to serve as ballast. Holes may be provided in the exterior ends of the battens of the batten array 1*b*, top sheet 1*c*, and bottom sheet 1*a* to allow for attachment of the support element array 2 so that the batten array 1*b* can effectively distribute the force applied by the support element array 2. The set screw 1*e* shown in FIG. 1 allows for the adjustment of the apron location with respect to the end of the pole, depending upon the depth to which the pole 5 shown in FIG. 5 can be inserted into the underlying surface. For specific or dedicated applications, the apron 1 can be permanently fixed in position. The setscrew 1*e* can be replaced with a thumbscrew or toggle clamp if frequent adjustment is anticipated. The sliding collar 3 is roughly cylindrical in shape with a hollow bore that permits the axial insertion of a pole, and is bored through radially and tapped to accept a thumbscrew 4. The thumbscrew allows the position of the sliding collar to be temporarily fixed with respect to the axially inserted pole 5. A cam locks or other device can be substituted as an adjustable means for locking the position of the collar with respect to the pole 5.

For applications in which the underlying surface is sufficiently hard to prevent significant insertion of the pole, the support element array is preferably made of a rigid material such as stainless steel or aluminum. In this mode, the pole is placed in a vertical position and the apron 1 is ballasted in a flat position. In this embodiment, the support element array is in effect an array of support rods that are capable of carrying a compressive load. After the apron 1 has been ballasted, the thumbscrew 4 is tightened.

Figure 5:
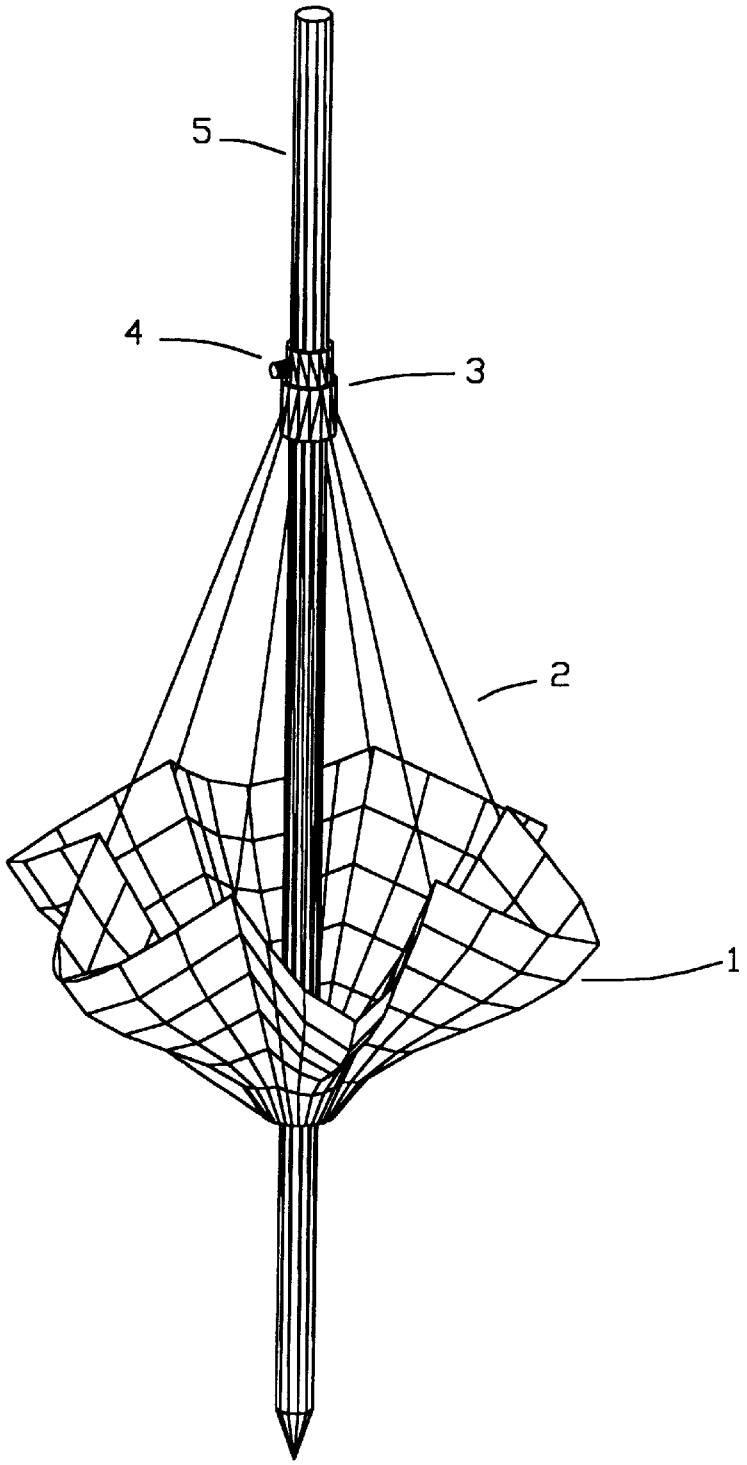
FIG. 5 is an isometric view of the pole anchor with the apron in the raised position.

FIG. 5 shows the slide collar 3 in a position such that the support element array holds the apron 1 in a basket shape. This shape can hold ballast material in a more compact volume than the flat shape shown in FIG. 4. When used in this mode, the support element array can be made of a flexible cord since the load is tensile in nature. This mode is also best suited to situations in which the supported pole can be inserted into the underlying surface.

It will be apparent to those skilled in the art that a variety of techniques can be used to assemble and join the components of the invention and that components such as set screws and thumbscrews can be replaced by clamps, cam locks and the like to achieve the same functionality. It will also be apparent that modifications to the proportions and shape of the components of the invention may be made to adapt the invention to a specific environment or use without departing from the scope and spirit of the invention as claimed.

What is claimed:

1. A portable pole anchor comprising (a) a first thin flexible sheet with an approximately circular shape, said sheet having a central hole located near its center, said hole also having a diameter sufficient to allow the passage of a cylindrical pole; and (b) a connector means disposed about said central hole for attaching said sheet to said pole; and (c) a second thin flexible sheet having a central hole and substantially identical to said first thin flexible sheet, said second sheet aligned with and bonded to said first sheet to form a composite sheet such that the bottom surface of said first sheet and the top surface of said second sheet and sustantially in contact and the central hole of said first sheet and the central hole of said first sheet and the central hole of said second sheet are aligned to form a composite hole to permit the passage of said cylindrical pole; and (d) a plurality of battens, said battens being arranged between said first sheet and said second sheet, said battens also being arranged as a radial array about said composite hole such that there exists a first annular portion of said composite sheet surrounding said composite hole in which no part of a batten is disposed between said first sheet and said second sheet; wherein there exists a second annular portion if said first annular portion in which the flexibility if said composite sheet is not altered by said connector means.

2. The portable pole anchor of claim 1 further including:

(a) a slide collar with approximately cylindrixal in shape with an axial bore capable of acccepting a pole; and (b) an adjustable locking means capable of preventing relative movement between said pole and said slide collar; and (c) a plurality of linear support elements, wherein one end of each support element its attached to said slide collar and the opposite end attached to the periphery of said composite sheet.

3. The portable pole anchor of claim 2 wherein said plurality of linear support elements consists of a array of support rods that are capable of carrying a compressive load.

4. The portable pole anchor of claim 2 wherein said plurality of linear support elements consists of lengths of flexible cord.

5. A portable pole anchor comprising (a) a thin flexible sheet with an approximately circular shape, said sheet having a central hole located near its center, said hole also having a diameter sufficient to allow the passage of a cylindrical pole; and (b) a connector means disposed about said central hole for attaching said sheet to said pole, (c) a slide collar; and (d) an adjustable locking means capable of preventing relative movement between said pole and said slide collar; and (e) a plurality of linear support elements, wherein one end of each support element is attached to said slide collar and the opposite end attached to the periphery of said thin flexible sheet.

6. The portable pole anchor of claim 5 wherein said plurality of linear support elements consists of an array of support rods that are capable of carrying a compressive load.

7. The portable pole anchor of claim 5 wherein said plurality of linear support elements consists of lengths of flexible cord.

* * * * *